US006148715A

United States Patent [19]

Granberg

[11] Patent Number: 6,148,715

[45] Date of Patent: Nov. 21, 2000

[54] SEALING BAND HOLDER

[75] Inventor: Rune Granberg, Aelvsjoe, Sweden

[73] Assignee: AB Rexroth Mecman, Stockholm, Sweden

[21] Appl. No.: 09/275,544

[22] Filed: Mar. 24, 1999

[30] Foreign Application Priority Data

Mar. 27, 1998 [SE] Sweden ..... 9801076

[51] Int. Cl.[7] ..... F01B 29/00

[52] U.S. Cl. ..... 92/88

[58] Field of Search ..... 92/88

[56] References Cited

U.S. PATENT DOCUMENTS

| | | | |
|---|---|---|---|
| Re. 33,637 | 7/1991 | Hoglund | 92/88 |
| 3,820,446 | 6/1974 | Granbom et al. | 92/88 |
| 3,871,267 | 3/1975 | Miller | 92/24 |
| 4,373,427 | 2/1983 | Garlapaty et al. | 92/88 |
| 4,555,980 | 12/1985 | Hoglund | 92/88 |
| 4,724,744 | 2/1988 | Rosengren | 92/88 |
| 4,852,465 | 8/1989 | Rosengren | 92/88 |
| 5,333,535 | 8/1994 | Miyamoto et al. | 92/88 |
| 5,473,971 | 12/1995 | Takeuchi et al. | 92/88 |

FOREIGN PATENT DOCUMENTS

| | | | |
|---|---|---|---|
| 0113790 | 7/1984 | European Pat. Off. | 92/88 |
| 3-4005 | 1/1991 | Japan | 92/88 |

*Primary Examiner*—John E. Ryznic
*Attorney, Agent, or Firm*—Townsend and Townsend and Crew LLP

[57] ABSTRACT

A device in an end wall (3) of a pressure fluid cylinder (1) of the kind including a cylinder tube (2), which is provided with a longitudinal slot and having a transfer means for transferring a movement from a moveable piston (11) inside the cylinder through the slot, and which is sealed by at least an inner (4) sealing band, wherein the device is arranged for fastening the end of the sealing band (4) in the cylinder end wall (3). The invention is distinguished by the end wall (3) being provided with an axially extending recess (5), which includes a first portion (9) adapted for axial reception of the inner sealing band and a second portion (10) for axial reception of a screw (6), said screw being adapted to engage with part of its thread a sealing band (4) which is inserted into the recess (5).

6 Claims, 1 Drawing Sheet

SEALING BAND HOLDER

BACKGROUND OF THE INVENTION

The invention concerns a device according to the preamble of claim 1 as well as a pressure fluid cylinder including one or two such devices.

Such a device is previously known from U.S. Pat. No. 4,555,980, wherein a fastening unit can be considered to be an integral part of the end wall, said unit having threaded holes for the cooperation with locking screws for the respective bands, and wherein a distance plate is insertable into a recess in the end wall.

The known device has not, however, fully complied with existing demands for accuracy with respect to positioning of the bands extending from the end wall, nor with respect to effective manufacture, simplicity in assembling and thus, in total, competitive costs for the necessary function.

It is an aim of this invention to develop the device according to the prior art so as to obtain safe function at a more competitive cost.

This aim is obtained in a device according to the above through the features of the characterizing portion of claim 1.

By the recess being shaped this way, simple and cost-effective manufacture as well as mounting is guaranteed of the inner sealing band in a pressure fluid cylinder. Hereby the fastening function is integrated in the end wall itself, eliminating the need for further elements besides the screw for obtaining clamping action, at the same time as the number of machining operations on the end wall is minimized. All together an economically and easy handled device is obtained. The inventive construction also provides the possibility of easy adjustment of the sealing band when it is mounted in the cylinder, since it is easy to apply a desired tension to the band, simply by effecting the screw which is located in the second portion.

The feature of claim 2 results in simple assembly and minimized machining of the end wall.

The feature of claim 3 results in easier mounting and adjustment of the band since the path of the band is not obstructed by a screw head.

The inventive aspect according to claim 4 is a preferred aspect of the invention leading to simplified manufacture of the cylinder end wall.

The invention also concerns a pressure fluid cylinder including one or two devices according to any one of the claims 1–5.

The invention will now be described at the background of embodiments and with reference to the drawings, wherein:

DETAILED DESCRIPTION

Figure 1:
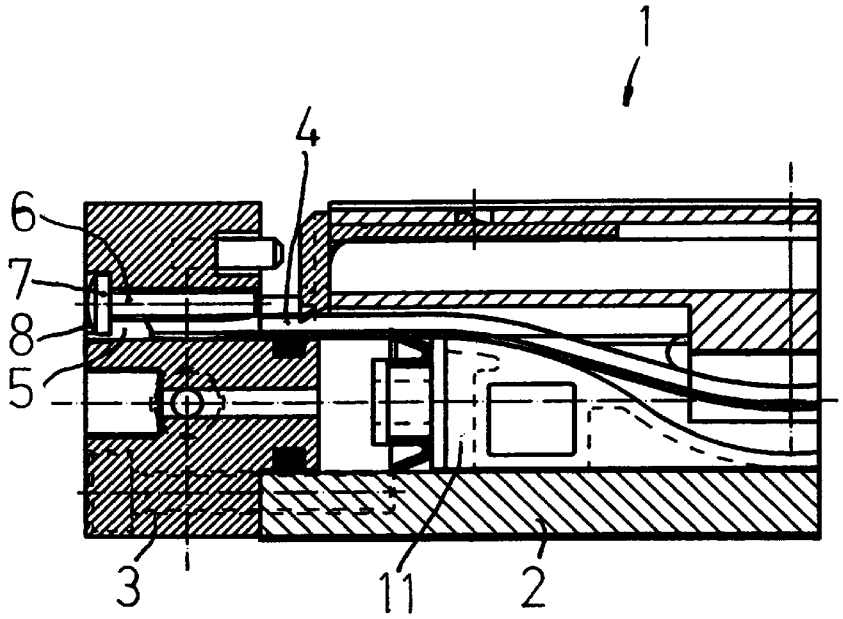
FIG. 1 shows an axial section through a part of the pressure fluid cylinder including a device according to the invention.

The end portion of a pressure fluid cylinder 1 shown on FIG. 1 includes a cylinder tube 2 having a moveable piston

11 inside and a cylinder end wall 3. Because the pressure fluid cylinder 1 is a rodless cylinder of the slot cylinder type, it includes an inner band 4 for sealing the slot against inside pressure. The inner sealing band 4 extends through a recess 5 in the end wall 3 which is arranged in line with the path of the band along the end regions of the cylinder tube, and is arranged to be held and tightened in this end wall recess with the aid of a screw 6 which presents threads for engagement with the band 4, such that rotation of the screw 6 result in an axial displacement of the band in this region. In order to adjust the band to a desired tension, the screw is thus rotated correspondingly by a tool such as a screw driver.

Figure 2:
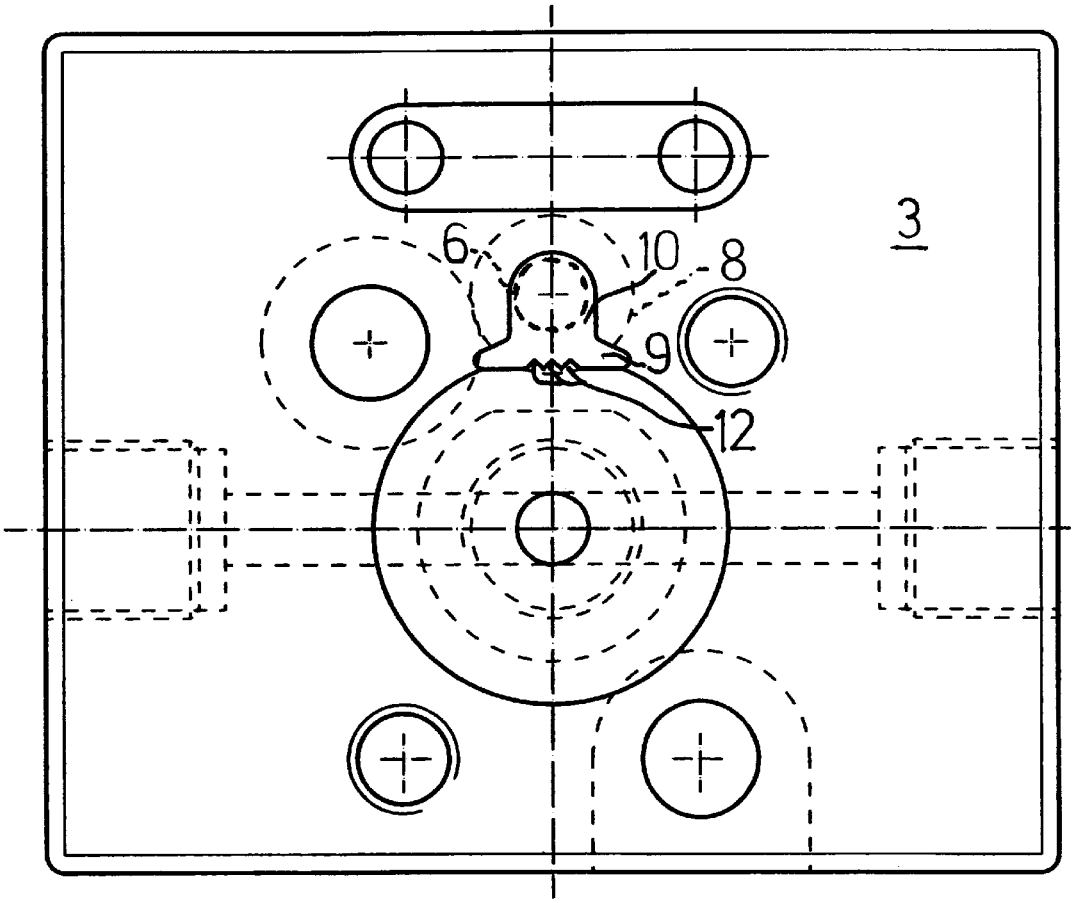
FIG. 2 shows the end wall of the device of FIG. 1 in a diagrammatic end view.

FIG. 2 shows the cross-section of the recess 5, wherein a lower first portion 9 is essentially complementary to the cross section of the band 4, and wherein an upper second portion 10 is adapted to receive the screw 6 (FIG. 1) while allowing free rotation of the screw. In the embodiment, the second portion is circular in cross section in the parts not adjoining to the first portion 9. Further, the dimensions of the recess is adapted to allow the screw 6 to safely engage with its threads into a band which passes inside the first portion. In order to reduce the risk of displacing the band sideways, possibly under deformation, when the screw is rotated, the recess is preferably provided with one or more guiding strips 12 extending axially in the bottom of the first portion 9, i.e. opposite to the second portion.

It is preferred that the end wall is produced as a profile body from an aluminium alloy in a conventional extrusion process, wherein the preferably closed recess 5 is drawn in profile and the end wall thereafter simply is cut and shaped.

The invention may be modified within the scope of the claims by varying the dimensions and shapes of the included parts shown on the different Figures without departing from the invention. The screw may thus be a pin screw, that is without a screw head, which gives the advantage that the band is not stopped axially by a screw head in the axially outer portion of the recess 5 during adjustment. The screw would than instead abut axially against an element at the bottom of the second portion or possibly against a portion of the cylinder tube (not shown). The screw thread is preferably cylindrical and the thread top preferably presents a sharp angle and relatively great thread amplitude in order to assure safe engagement.

The presence of an arrangement according to the invention in a slot cylinder does not exclude the use of also an outer sealing band in the cylinder.

Within the scope of the invention is also included an embodiment wherein the band is axially fastened in the recess 5 by for example pointed protrusions in the area of the guide strips 12 in FIG. 2 and wherein the tensioning is provided by axial driving of the screw 6.

The end wall may also be die-cast in a suitable alloy.

What is claimed is:

1. Device in an end wall (3) of a pressure fluid cylinder (1) of the kind including a cylinder tube (2), which is provided with a longitudinal slot and having a transfer means, being provided to transfer a movement from a moveable piston (11) inside the cylinder through the slot, which is sealed by at least an inner (4) sealing band, wherein the device is arranged to hold the end of the sealing band (4) in the cylinder end wall (3), characterized in that the end wall (3) is provided with an axially extending recess (5) which includes a first portion (9) adapted for axial reception of the inner sealing band and a second portion (10) for axial reception of a screw (6) while allowing it to rotate therein, said screw being adapted to engage with its thread a sealing band (4) which is inserted into the recess (5).

2. Device according to claim 1, characterized in that the screw (6) is provided with a screw head (7) for abutment (8) against the end wall (3).

3. Device according to claim 1, characterized in that the screw is a pin screw without a head (7), wherein the screw is adapted to abut an abutment in the bottom of the second portion.

4. Device according to claim 1, characterized in that the end wall (3) is produced from a profile body having the recess (5) drawn in the profile.

5. Device according to claim 1, characterized in that the recess (5) includes at least one axially extending guiding strip (12) on a wall of the first portion opposite to the second portion (10).

6. Pressure fluid cylinder (1) including one or two devices according to claim 1.

* * * * *